United States Patent [19]

Frahm et al.

[11] 4,029,209

[45] June 14, 1977

[54] STACKABLE CARRYING CASE

[76] Inventors: Carl E. Frahm; Shirley E. Frahm, both of 133 Maple Ave., Monrovia, Calif. 91016

[22] Filed: May 3, 1976

[21] Appl. No.: 682,525

[52] U.S. Cl. ..... 206/510; 206/203; 220/21; 220/22

[51] Int. Cl.[2] ..... B65D 21/02; B65D 25/04; B65D 1/24

[58] Field of Search ..... 206/509, 510, 203; 220/21, 22, 22.1, 22.2, 22.3

[56] References Cited

UNITED STATES PATENTS

| | | | |
|---|---|---|---|
| 2,467,698 | 4/1949 | Reynolds | 206/509 |
| 2,974,819 | 3/1961 | Melville | 206/510 |
| 3,148,797 | 9/1964 | Cloyd | 220/21 |
| 3,240,385 | 3/1966 | Gits | 206/509 |
| 3,376,998 | 4/1968 | Cornelius | 220/21 |
| 3,403,814 | 10/1968 | Asenbauer | 206/509 |
| 3,473,690 | 10/1969 | DeCazenore | 206/509 |

*Primary Examiner*—George E. Lowrance
*Attorney, Agent, or Firm*—Frank E. Mauritz

[57] ABSTRACT

A plastic carrying case is constructed with a special elevated center divider and an inner depressed ledge portion and also with a special lower grooved portion that allows the center divider of a lower case to enter and be guided by the lower grooved portion of an upper case to facilitate movement of an upper case onto the ledge portion of the lower case. There is a special interrelationship between the center divider and the lower grooved portion of an adjacent case that assures rigidity yet facilitates intentional removal. The case walls are of thin construction for economy reinforced, however, by vertical beads through which compressive forces are transmitted.

6 Claims, 4 Drawing Figures

STACKABLE CARRYING CASE

The present invention relates to improved stackable cases.

An object of the present invention is to provide a case readily stackable with like cases with structural features that minimize plastic material, facilitate stacking and handling and yet provide ruggedness and strength for repeated use in practice.

Figure 1:
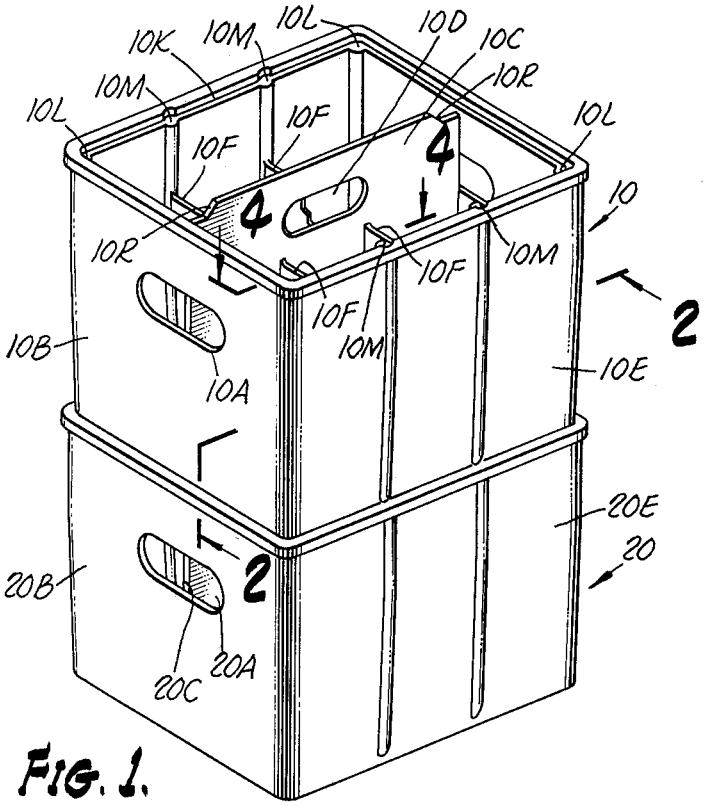

Other objects and advantages of the present invention will be apparent from the following description, reference being made to the accompanying drawings wherein:

FIG. 1 is a perspective view showing two identical cases in stacked relation.

Figure 2:
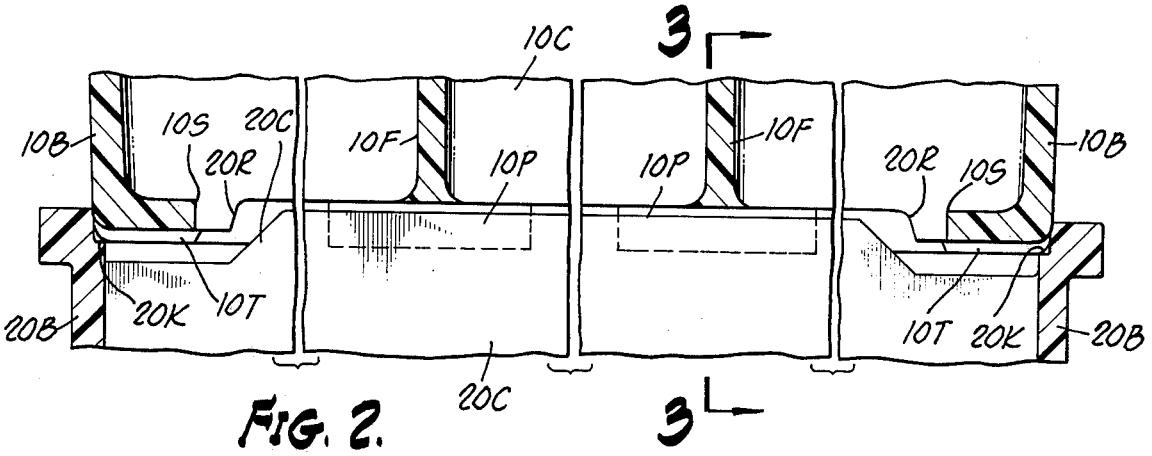
Figure 3:
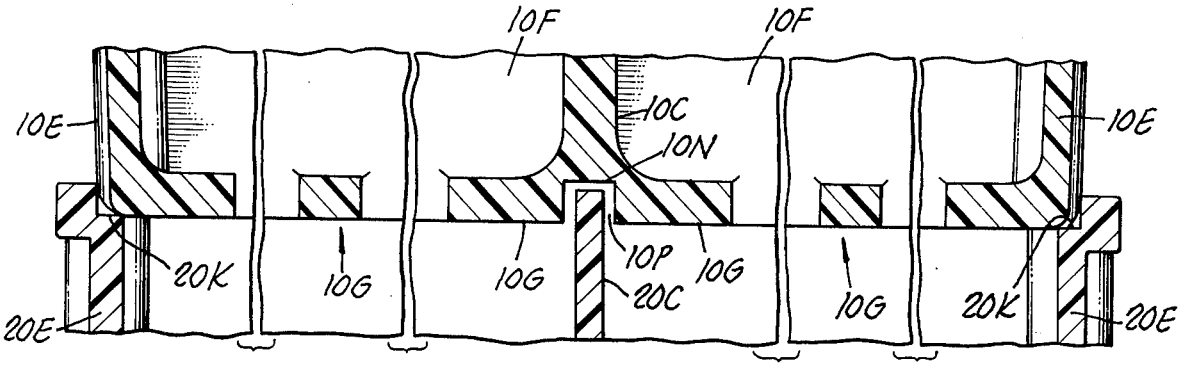

FIG. 2 and FIG. 3 are views taken on corresponding lines 2—2 and 3—3 in FIGS. 1 and 2 respectively.

Figure 4:
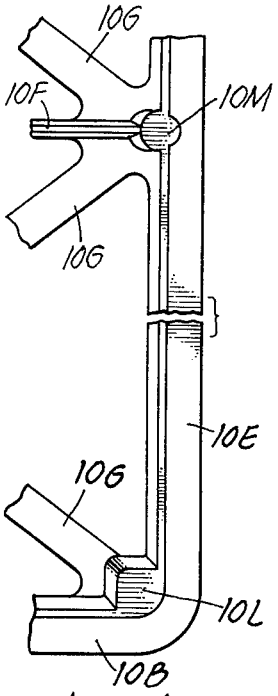

FIG. 4 is a top plan view showing a portion of one of the cases.

The cases 10, 20 are of identical construction and each is generally rectangular with a pair of hand holes 10A, 20A on opposite end walls 10B, 20B. A center divider 10C, 20C ends between corresponding end walls and there is a centrally located hand hole in each such divider 10C, 20C as typified by the hand hole 10D in FIG. 1.

The side walls 10E, 20E extend parallel to the corresponding center divider 10C, 20C and are joined to corresponding end walls 10B, 20B.

Each case 10, 20 is compartmentized into six compartments using four thin wall webs 10F, 20F with two of such spaced webs 10F, 20F extending from opposite sides of the center divider 10C, 20C as illustrated by the four webs 10F in FIGS. 1 and 3. The bottoms of each of such six compartments is defined by an integrally formed open web or lattice type structure 10G to allow for drainage of liquids from the case.

The construction of the end and side walls and their relationship to each other and to the center divider is important in accomplishing easy and sturdy nesting of one case on top of the other as shown in FIG. 1.

For this purpose each case is formed with an inner continuous rectangular ledge 10K, 20K slightly below the uppermost edge of the case so as to be engaged by the bottommost portion of a like case resting on top of such ledge.

Each case is of plastic and to minimize the use of plastic material and yet achieve a strong sturdy construction capable of withstanding heavy stacking forces. The walls themselves are relatively thin but are reinforced at the corners and also at two spaced regions along the side walls by vertically extending beads of integrally formed plastic material, the corner beads being designated by the reference number 10L and the intermediate beads on the side walls by the reference numeral 10M. The upper ends of these beads 10L, 10M terminate flush with and form part of the ledge 10K and are used to transmit compression forces from case to case when stacked on top of each other as illustrated in FIG. 1.

To facilitate handling and stacking of the case and to also provide additional rigidity in the stacked condition, there is a special interaction between center dividers of adjacent cases, such dividers being of special construction as now described.

Each divider 10C, 20C is sufficiently prolonged to extend upwardly beyond the upper rectangular edge or end defined by the four walls and such center divider 10C, 20C terminates at its lower end as indicated at 10N in FIG. 3 above the ledge 20K of the lower case 20 so that there is some clearance between the adjacent dividers 10C, 20C of adjacent cases. However some of the web or lattice material extends lower and is formed with two spaced grooved portions 10P which serve not only as a guide to facilitate the stacking operation but also for added stability in the final nested position.

For these same general purposes the upper ends of each divider is notched at its opposite ends as indicated to provide shouldered portions 10R, 20R that are spaced from abutments 10S within which a shallow groove 10T is formed, the groove 10T being of lower elevation than the grooves 10P but aligned therewith.

Once stacked the uppermost case may be removed by lifting it vertically upwardly or by tilting one end and pulling it to cause the abutment 10S (FIG. 2) to engage and then ride over the notched or cam portion 20R of divider 20C while being guided in the aligned grooved portions 10P, 10T.

We claim:

1. A generally rectangular stackable carrying case having a pair of end walls and a pair of side walls joined to said end walls; a center divider partition member extending between and joined to said end walls; said end walls and said side walls each being formed with an internal ledge portion; each of said ledge portions being joined to provide a continuous generally rectangular ledge located an equal distance below the top edge of each of said end and said side walls; said partition member being generally planar and extending (above the top edge) above said top edge of each of said end and side walls; said partition member terminating near the bottom of said case at an elevation above the bottom edges of said end and said side walls; said bottom edges of said end and said side walls terminating in a plane which is below the bottom of said partition member; means extending inwardly from said end and said side walls and forming a channel means with the lowermost portion of said partition member; said channel means being receptive to and serving as a guide means for the uppermost extending portion of a partition member of a like case, said uppermost extending portion cooperating with said channel means to guide movement of said case when said case is tilted upwardly from engagment with the ledge portions of said end walls and is slid on the ledge portions of said side walls.

2. An arrangement as set forth in claim 1 in which said means forming said channel means is a part of a lattice structure which forms the bottom of said case.

3. An arrangement as set forth in claim 1 in which abutment means are formed on the lower surface of said partition member at each of said end members; and the upper edge of said partition member has a beveled surface for engagement with a corresponding one of said abutments.

4. An arrangement as set forth in claim 3 in which said abutment means cooperates with means for defining a channel that is aligned with said channel means and through which the upper edge of said partition member of a like case may move, said partition member of a like case when moved in said channel contacts said channel and raises said case upwardly from engagement of said ledge of a like case.

5. An arrangement as set forth in claim 1 in which said channel means is sufficiently enlarged such that the uppermost edge of a partition member of one case does not engage the lowermost edge of a like partition of a case stacked with respect thereto and such that one case rests on the ledge of the other case.

6. An arrangment as set forth in claim 5 in which said side walls are formed with spaced vertical rib members with rib members on stacked cases being aligned to transmit compressive forces therebetween.

* * * * *

UNITED STATES PATENT AND TRADEMARK OFFICE

CERTIFICATE OF CORRECTION

PATENT NO. : 4,029,209

DATED : June 14, 1977

INVENTOR(S) : Carl E. Frahm et al

It is certified that error appears in the above-identified patent and that said Letters Patent are hereby corrected as shown below:

Column 2, claim 1, lines 26-27, delete "(above the top edge)".

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*